United States Patent [19]

Reynolds

[11] 4,245,547

[45] Jan. 20, 1981

[54] ROTARY TO LINEAR SERVO MECHANISMS

[75] Inventor: Ronald W. Reynolds, Youngstown, Ohio

[73] Assignee: Commercial Shearing, Inc., Youngstown, Ohio

[21] Appl. No.: 847,069

[22] Filed: Oct. 31, 1977

[51] Int. Cl.[3] ..... F15B 13/04

[52] U.S. Cl. ..... 91/49; 91/375 R; 91/422

[58] Field of Search ..... 91/49, 375 R, 401, 422, 91/470

[56] References Cited

U.S. PATENT DOCUMENTS

| | | | |
|---|---|---|---|
| 1,449,736 | 3/1923 | Degen | 91/401 X |
| 2,132,486 | 10/1938 | Lichte | 91/375 X |
| 2,434,668 | 1/1948 | May | 91/375 |
| 2,992,633 | 7/1961 | Stiglic et al. | 91/49 |
| 3,106,224 | 10/1963 | Moss et al. | 91/49 X |

FOREIGN PATENT DOCUMENTS

| | | | |
|---|---|---|---|
| 741199 | 11/1943 | Fed. Rep. of Germany | 91/49 |

*Primary Examiner*—Irwin C. Cohen

*Attorney, Agent, or Firm*—Buell, Blenko, Ziesenheim & Beck

[57] ABSTRACT

A rotary to linear servo mechanism for converting low force mechanical rotary motion into hydraulic motion is provided which includes a piston linearly movable in one end of a bore and a valve rotatably mounted in the other end of the bore for cooperation with the piston to selectively deliver pressure fluid to opposite sides of the piston to move said piston selectively in either direction in said bore.

4 Claims, 9 Drawing Figures

ROTARY TO LINEAR SERVO MECHANISMS

This invention relates to rotary to linear servo mechanisms and particularly to a low cost means for converting low force mechanical rotary input into hydraulically assisted linear output.

There are many situations where it is desirable to convert low force mechanical rotary input into hydraulically assisted linear output. In such an apparatus, an operator can by rotating a control member manually, cause a large linear force to be exerted.

In the present invention this is accomplished by one of a variety of valve species all of which are operated by a rotary manual member to provide a controlled linear motion. Generally, I provide a source of fluid under pressure, an elongate bore in said housing, inlet means in said housing connecting said bore with said source of fluid under pressure, a reservoir spaced from said housing, an outlet means in said housing connecting said bore with said reservoir, a piston movable axially in one end of said bore, rotatable valve means in the other end of said bore, said valve means controlling the flow of fluid from said passage whereby in one position of the valve, fluid acts on the piston urging it axially out of the bore and in a second position, fluid is by-passed from the source to said reservoir through said second passage and is released from said piston. Preferably, the valve means is at least partially contained in a bore in the piston. Means are preferably provided for normally urging said piston inwardly of the bore against the fluid pressure acting to urge the piston out of the bore. The piston is held against rotation in the bore.

In the foregoing general description of this invention, certain objects, purpose and advantages of this invention have been set out. Other objects, purposes and advantages of this invention will be apparent from a consideration of the following description and the accompanying drawings in which, FIG. 1 is a longitudinal section through one embodiment of a rotary to linear servo according to this invention;

Figure 1:
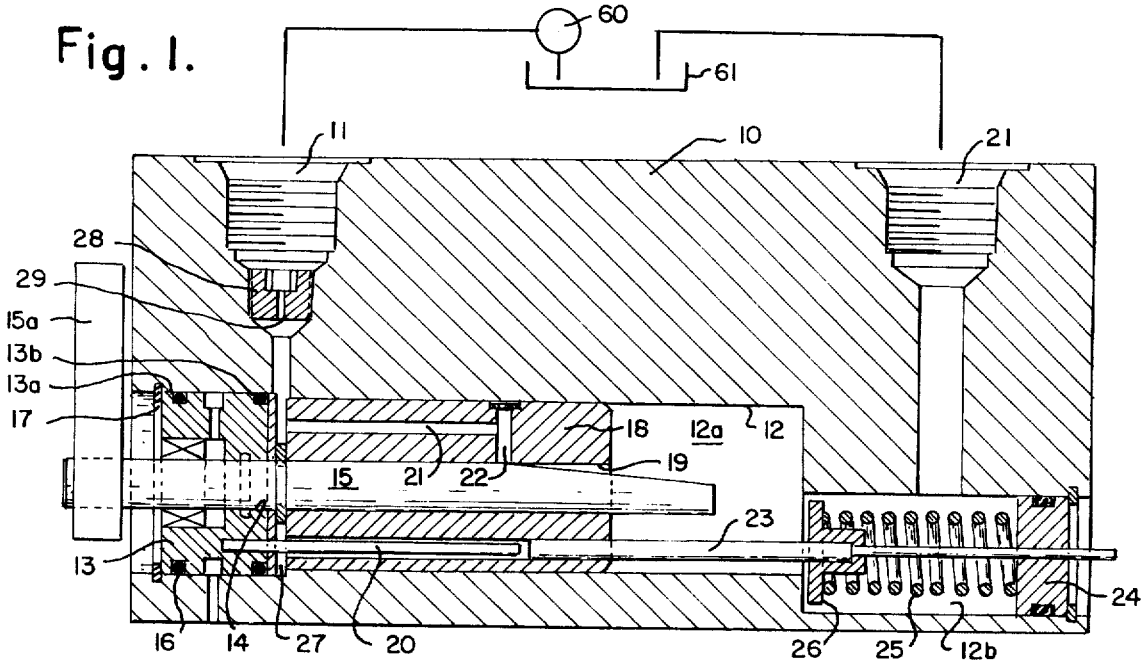

Referring to the drawings, there is illustrated in FIG. 1 an embodiment of rotary to linear servo having a housing 10 with an inlet port 11 and an exhaust or outlet port 21, both communicating with an elongate stepped bore 12 extending through the housing, the bore 12 is made up of a primary bore **12*a* and a secondary bore 12*b*. Bore 12*a* at its outer end is provided with a closure member 13 having a central opening 14 carrying a valving rod 15 for rotation therein by handle 15*a*. The closure member 13 is provided with circumferential ring seals 16 in annular wells 13*a* and 13*b* and is held in place by a snap ring 17. A piston 18 having a bore 19 receiving the valving rod 15 is movable in bore 12*a* on guide rod 20 extending lengthwise of the bore from closure member 13. The guide rod 20 prevents rotation of piston 18. Piston 18 is provided with a longitudinally extending passage 21 extending from its end adjacent the closure member to a point intermediate its length where it intersects a transverse passage 22. The piston 18 carries an operating rod 23 which extends through bore 12*b* and out of housing 10 through closure member 24 to provide a linear component of motion. A spring 25 extends from closure member 24 to shoulder 26 on operating rod 23. A snap ring spacer 15*a* on valving rod 15 spaces the end of piston 18 away from closure member 13 to provide a fluid pressure area 27 behind the piston. The inlet opening 11 is preferably provided with a metering jet 28 having a controlled orifice 29 delivering fluid to pressure area 27 from a pump 60**.

The operation of this device is as follows. Rotation of handle **15*a* causes rod 15 having a cutaway portion 15*b* on one side to rotate so as to block passage 22 in piston 18. This stops fluid flow from inlet 11 through orifice 29, pressure area 27, passages 21 and 27 into bore 12*a* and through bore 12*b* to outlet 21. With passage 22 blocked, the fluid pressure in area 27 will build up until the force on piston 18 is sufficient to overcome the pressures of spring 25 and piston 18 moves to the right, viewing FIG. 1. Piston 18 moves to the right until passage 22 is uncovered and fluid flows out of it. At this point, pressure in area 27 drops until the force in area 27 on piston 18 balances the force of spring 25, at which point the piston remains balanced. In this position, passage 22 is acting as an orifice maintaining area 27 at constant pressure, which, in turn, maintains the piston 18 in position. If handle 15*a* is returned to its original neutral position, as shown in FIG. 1, opening passage 22, the pressure in area 27 drops and fluid flows through passages 21 and 22 into bore 12*a* on the opposite side of piston 18 from area 27 and spring 25 returns piston 18 to its original neutral position, shown in FIG. 1, with excess fluid passing from outer port 21 to tank 61. Movement of piston 18 causes movement of rod 23** which provides the external linear motion.

Figure 2:
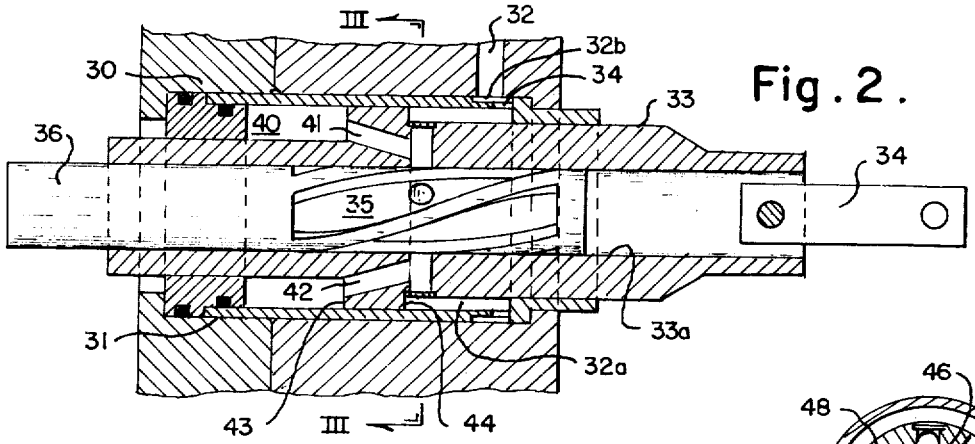
FIG. 2 is a longitudinal section through a second embodiment of a rotary to linear servo according to this invention.
Figure 3:
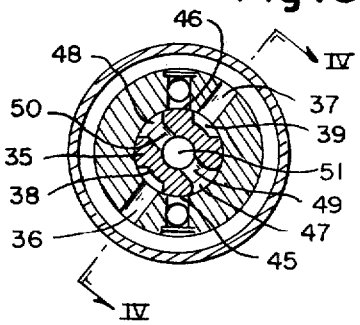
FIG. 3 is a section on the line III—III of FIG. 2.
Figure 4:
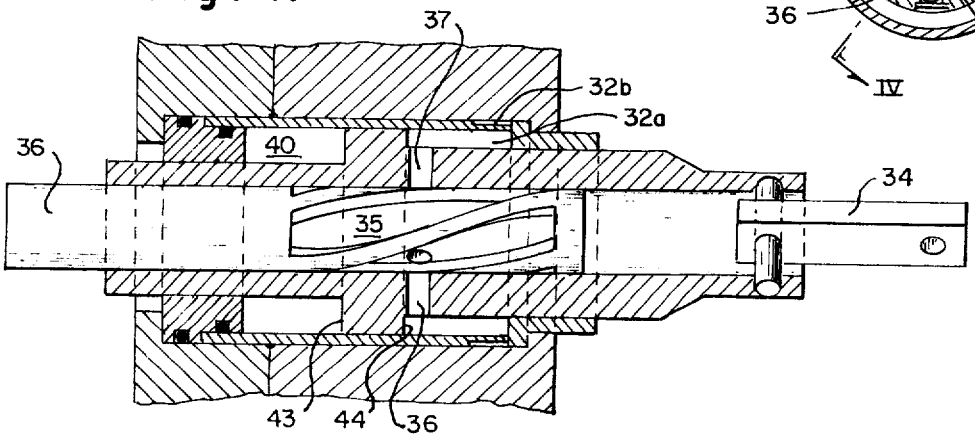
FIG. 4 is a section on the line IV—IV of FIG. 3.
Figure 7:
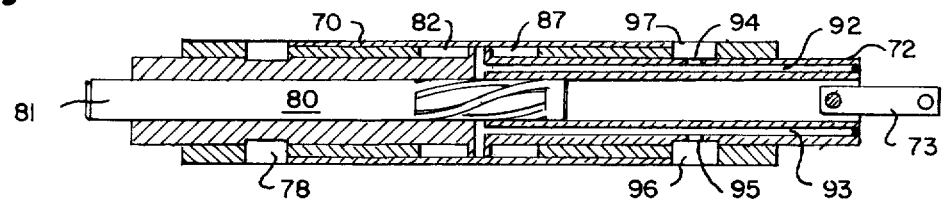
FIG. 7 is a section on the line VII—VII of FIG. 6.

In FIGS. 2–4, there is illustrated a second embodiment of this invention having a housing 30, having a generally axial bore 31 communicating with a source of fluid pressure through inlet 32. A stroking piston 33 attached to an external device to be linearly moved by link 34 is movable in one end of base 31. A rotary valve 35 attached to operating rod 36 is provided in the opposite end of said bore. Said valve 35 is preferably rotatable in an axial bore **33*a* of piston 33. In operation, control fluid under pressure is delivered from a source of pressure fluid, e.g., a pump, not shown, through inlet 32 into cavity 32*b* through inlet hole 34, and annulus 32*a* in housing 30. From cavity 32*b* control fluid passes through passages 36 and 37 in piston 33 along annuli 38 and 39 in valve 35. When valve 35 is rotated counterclockwise, viewing FIG. 3, fluid flow is directed to cavity 40 through the annuli 38 and 39 and through passages 41 and 42 in piston 33. The end area 43 of piston 33 is approximately twice the area 44 of piston 33 so that the pressure on area 44 will cause piston 33 to move to the right viewing FIG. 2 until lands 45 and 46 cover passages 41 and 42 which will then hold the position of the stroking piston 1. If the control valve spool 35 is rotated clockwise, viewing FIG. 3, fluid in cavity 40 will be connected to reservoir tank, not shown, through passages 41 and 42, annuli 47 and 48, holes 49 and 50, and axial passage 51. At this point, fluid pressure acting on area 44 will cause piston 33 to move to the left, viewing FIG. 2, until lands 45 and 46 cover passages 41 and 42 at which point the piston 33 will be held stationary. Link 34 of this embodiment, like rod 23 of the embodiment of FIG. 1 transmits the linear movement of piston 33** to a device to be linearly moved.

Figure 5:
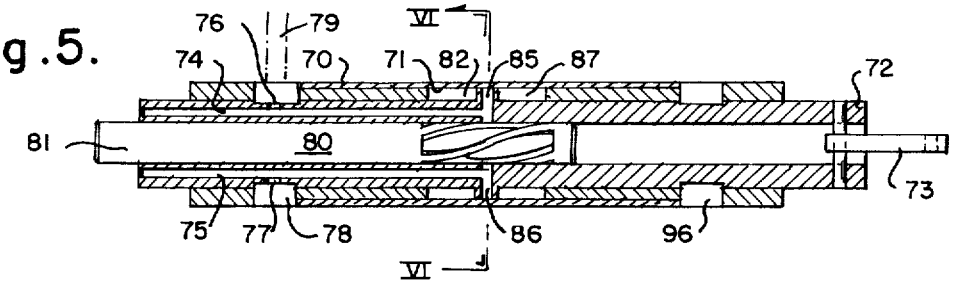
FIG. 5 is a longitudinal section through a third embodiment of a rotary to linear servo according to this invention.
Figure 8:
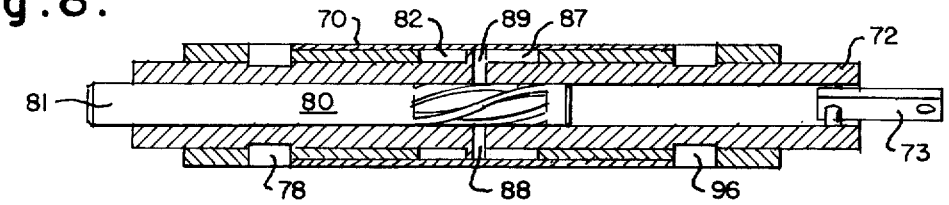
FIG. 8 is a section on the line VIII—VIII of FIG. 6.
Figure 9:
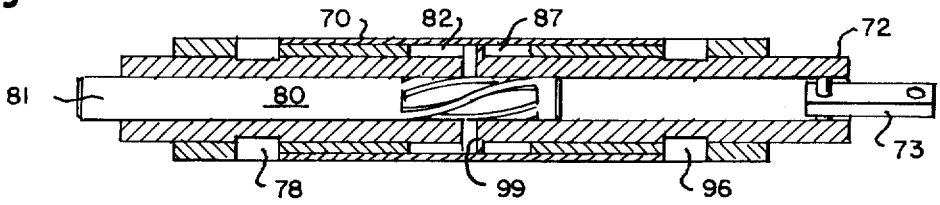
FIG. 9 is a section on the line IX—IX of FIG. 6.
Figure 6:
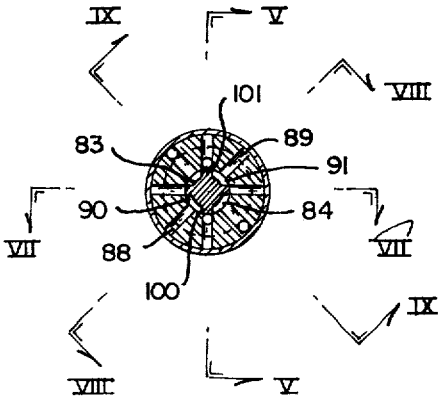
FIG. 6 is a section on the line VI—VI of FIG. 5.

In FIG. 3, still another embodiment of this invention is illustrated having a housing 70 with an elongate axial bore 71 carrying stroking piston 72 with link 73 for connecting to an external device to be linearly moved. In this embodiment, control fluid from a source of fluid pressure, not shown, enters area 74 and 75 through holes 76 and 77 and annulus 78 from input port 79 in housing 70. When control valve spool 80 is rotated clockwise by control rod 81, viewing FIG. 6, fluid is delivered to cavity 82 through passages 74 and 75, spool grooves 83 and 84 and passages 85 and 86. At the same time, cavity 87 is connected to the tank, not shown, through passages 88 and 89, spool grooves 90 and 91 and passages 92 and 93, through holes 94 and 95 and annulus 96 and outlet ports 97. Fluid acting on area 99 will move piston 72 to the right viewing FIG. 5 until passages 85 and 86, and passages 88 and 89 are covered by the spiral lands 100 and 101 of valve spool 80 at which point stroking piston 72 will be held. If the control valve spool 80 is rotated counter clockwise cavity 87 receives fluid flow from passages 88 and 89, valve spool grooves 90 and 91, and passages 74 and 75. Cavity 82 is simultaneously connected to the tank, not shown, through passages 85 and 86, 82, 84, 92 and 93 then through holes 94 and 95 and annulus 96 and out through outlet or exhaust port 97. Fluid acting in cavity 87 will move the stroking piston 72 leftward, viewing FIG. 5, until passages 85 and 86, 87 and 88 are covered by lands of spool 80 which will again hold the position of the control piston 72.

In the foregoing specification, certain preferred embodiments and practices of this invention are disclosed, however, it will be understood that this invention may be otherwise embodied within the scope of the following claims.

I claim:

1. A rotary to linear servo mechanism for converting low force mechanical rotary motion into hydraulically assisted linear motion, comprising a source of fluid under pressure, a housing, an elongate bore in said housing, first passage means in said housing connecting said bore with the source of fluid under pressure, a fluid reservoir spaced from the housing, second passage means in said housing connecting said bore with said reservoir, a piston movable axially in one end of said bore, said piston having a hollow axial bore therethrough, rotatable valve means extending through said axial bore of the piston, said valve means having a tapered end passage means controlling the flow of fluid from said first passage means by rotation within the bore of said piston whereby in one rotated position of the valve means said bore is blocked and fluid acts on one side of the piston urging it axially of the bore in the housing in one direction to a preselected position, said value means including by pass means in said piston communicating with said axial bore whereby fluid from the inlet passes around the end of said valve means in said axial bore to the opposite side of the piston to stop movement of said piston in said one direction and in a second rotated position of said value means fluid is delivered through said axial bore in the piston and tapered end passage means from a point intermediate the valve end to the opposite side of the piston and resilient means in said bore normally biasing said piston in said opposite direction urging it axially of the bore in the opposite direction, wherein said valve means is a rod, said rod having handle means at one end externally of said housing for rotating said rod and the other end being cut away at an angle defining said tapered end passage means, and connection means on said piston extending externally of the bore in the housing.

2. A mechanism as claimed in claim 1 wherein said resilient means is a spring.

3. A mechanism as claimed in claim 2 wherein the piston has a passage means receiving fluid from the inlet and delivering it to said bore intermediate its length and the valve means selectively opens and closes said passage on rotation whereby the fluid under pressure is selectively delivered to one end of the piston or the other to move said piston in the bore.

4. A mechanism as claimed in claim 1 including means acting on the piston preventing rotation of said piston.

* * * * *